United States Patent [19]

Klein-Albenhausen

[11] 4,375,335

[45] Mar. 1, 1983

[54] SILO COMBINATION FOR MIXING STORED MATERIAL

[76] Inventor: Heinrich Klein-Albenhausen, Amsinckstrasse 45 2000, Hamburg 1, Fed. Rep. of Germany

[21] Appl. No.: 811,618

[22] Filed: Jun. 30, 1977

[51] Int. Cl.[3] ..... B01F 15/02; B28C 5/00; B67D 5/08

[52] U.S. Cl. ..... 366/15; 222/55; 222/637; 366/107; 366/132; 366/134; 366/153; 406/23; 406/90

[58] Field of Search ..... 259/DIG. 17, 4 R; 366/132, 134, 341, 15, 153, 179, 181, 106, 107; 222/55, 637, 630; 302/41, 57

[56] References Cited

U.S. PATENT DOCUMENTS

| | | | |
|---|---|---|---|
| 2,385,494 | 9/1945 | Boynton | 366/181 |
| 3,158,362 | 11/1964 | Seifarth | 366/134 |
| 3,188,144 | 6/1965 | Gmur et al. | 406/23 |
| 3,291,457 | 12/1966 | Hermanns | 366/107 |
| 3,656,717 | 4/1972 | Klein et al. | 366/106 |
| 3,871,629 | 3/1975 | Hishida | 366/181 |
| 3,913,891 | 10/1975 | Steele | 259/DIG. 17 |
| 4,002,323 | 1/1977 | Grun | 259/DIG. 17 |

OTHER PUBLICATIONS

Elements and Plants, IBAU Hamburg, Germany.

*Primary Examiner*—Billy S. Taylor
*Attorney, Agent, or Firm*—Staas & Halsey

[57] ABSTRACT

A combined mixing and homogenizing silo whereby the layers of material stored in the mixing silo in the case of removing quantities of material into the homogenizing silo via corresponding dosing and blocking organs flow into one another and are mixed in consequence of the formation of cones whereby the quantity of material drawn from the mixing silo into the homogenizing silo which corresponds to a partial area of the series connected homogenizing silo is homogenized with the help of aerating elements.

17 Claims, 3 Drawing Figures

SILO COMBINATION FOR MIXING STORED MATERIAL

BACKGROUND AND SUMMARY OF INVENTION

The invention relates to a silo (a silo combination) for mixing stored material.

Homogenizing silos have been known where turning over and the intermixing of material are achieved by intensive aeration of bottom sections. The advantage lies in achieving a high homogenization of the material. The disadvantage of this system lies in the size of the silos which is required. Conditional on this large silo unit, large quantities of air at a high pressure (expenditure of power) are required in order to make the material turn over and thus intermix it. A further disadvantage of this system lies in the discontinuity of the mixing process, since a charge always has to be mixed over an extended period of time of several hours.

Continuous mixing silos are also known, in which different layers are cut up and mixed up by gravitation at the outlet by the formation of "cones" or "funnels" of layered material which extend down toward an outlet. The advantages lie in the low power requirement and in the continuity of the mixing process. The disadvantage of this system lies in the limited mixing performance.

The invention is directed to a silo of the initially mentioned type which makes it possible to combine the advantages of both types of silos (homogenizing silo and continuous mixing silo) with simultaneous elimination of the disadvantages.

According to the invention, this is accomplished by the combination of a mixing silo with a homogenizing silo, whereby the layers of material stored in the mixing silo will flow into one another and be mixed in consequence of the formation of cones when material is transferred from the mixing silo to the homogenizing silo via dosing and blocking organs, and whereby the quantity of material drawn from the mixing silo into the homogenizing silo is homogenized with the help of aerating elements.

At the same time, residual homogenization according to the invention takes place in the outlet connected homogenizing silo. The advantage of this silo according to the invention consists in the fact that it is possible to combine the known types of silo without causing new disadvantages thereby.

Premixing of the material is accomplished by emptying the mixing silo into the homogenizing silo in such a way that the layers of material present in the mixing silo flow into one another and are mixed by the formation of so-called cones. Perfect operation of the silo is achieved only when the flow of the bulk material in the mixing silo is correct. That portion of the mixing silo having bulk material movement should be as large as possible during emptying, i.e., the bulk material should be drawn off as evenly as possible over the entire inside space of the silo. The drawing off from the mixing silo into the homogenizing silo takes place in a controlled manner by way of "dosing and locking organs" or flow control gates, and so-called cones develop in the mixing silo above the pertinent drawing off element; that is to say, the various layers of material located above the locking organ are funneled in the direction of the drawing off aperture. One dosing and locking organ after another is triggered at predetermined time intervals and, simultaneously, the required aeration for the associated bottom section takes place. Every such emptying section of the mixing silo is triggered successively, or else according to a predetermined sequence, in such a way that the material in the mixing silo will remain approximately level during the emptying process. Accordingly, during the emptying process from the mixing silo into the following homogenizing silo, an intermixing of the layers of material located in the silo takes place. The quantity of material drawn off into the homogenizing silo from the mixing silo, however, will still have heterogeneities. In prior art silos in which the formation of cones is not controlled, as for example by successively activating different drawing-off apertures, it is possible that bulk materials freshly put into the mixing silo might punch or seep through to the outlet aperture without participating in the mixing process. In contrast thereto, in the case of the silo of the invention, and because of the formation of cones, the composition of the material drawn from the mixing silo into the homogenizing silo corresponds to the composition of the quantity of material stored in the silo. This means that the material drawn into the homogenizing silo constitutes a representative cross section of the entire quantity of bulk material which had been stored in the silo of the invention. The further homogenization of this quantity of material in the homogenizing silo therefore produces a homogenized mass having the composition of the quantity of bulk material stored into the silo of the invention. However, because of the optimal utilization of the mixing silo and of the homogenizing silo, a very high effect of intermixing will be achieved. The silo of the invention operates in a continuous mixing process, so that only as much material is drawn from the mixing silo into the homogenizing silo as is removed from the homogenizing silo.

The completely homogenous mixing of the bulk material stored in the silo of the invention is brought about by the above-described combination of the mixing silo with the homogenizing silo.

According to a particularly preferred embodiment of the silo of the invention, the mixing silo is fed by way of a distributor "spider" which produces a spider-like distribution, making it possible to feed material of variable quality in layers into the silo of the invention.

According to a further especially preferred embodiment, the air blow in by way of aeration elements in the bottom of the homogenizing silo is taken out via a filter on the ceiling of the homogenizing silo.

In order to allow material in the homogenizing silo to be turned over, an expansion chamber will have to be provided above the material to be mixed. The mixing process is brought about by the fact that, in a so-called, active aeration zone of the bottom, a considerable larger quantity of air is blown in than in the inactive zone, with the consequence that above this bottom section of the active zone, the material will rise upward and flow over to the less aerated areas, which on their part will feed the active zone with material as a result of low (weak) aeration.

Any impeding of this turn-over process as a result of a non-secured expansion space at the top of the homogenizing silo would exclude any turning over and thus any intermixing of the material.

The free (empty) upper space in the homogenizing silo is secured by supplying material from the mixing silo into the homogenizing silo regulated via dosing slides. The control of these dosing slides can be accomplished by a level recorder in the homogenizing silo.

In the attached drawing, an embodiment of the present invention is shown by way of example and will be described in more detail in the following paragraphs:

DESCRIPTION OF THE PREFERRED EMBODIMENT

Figure 1:
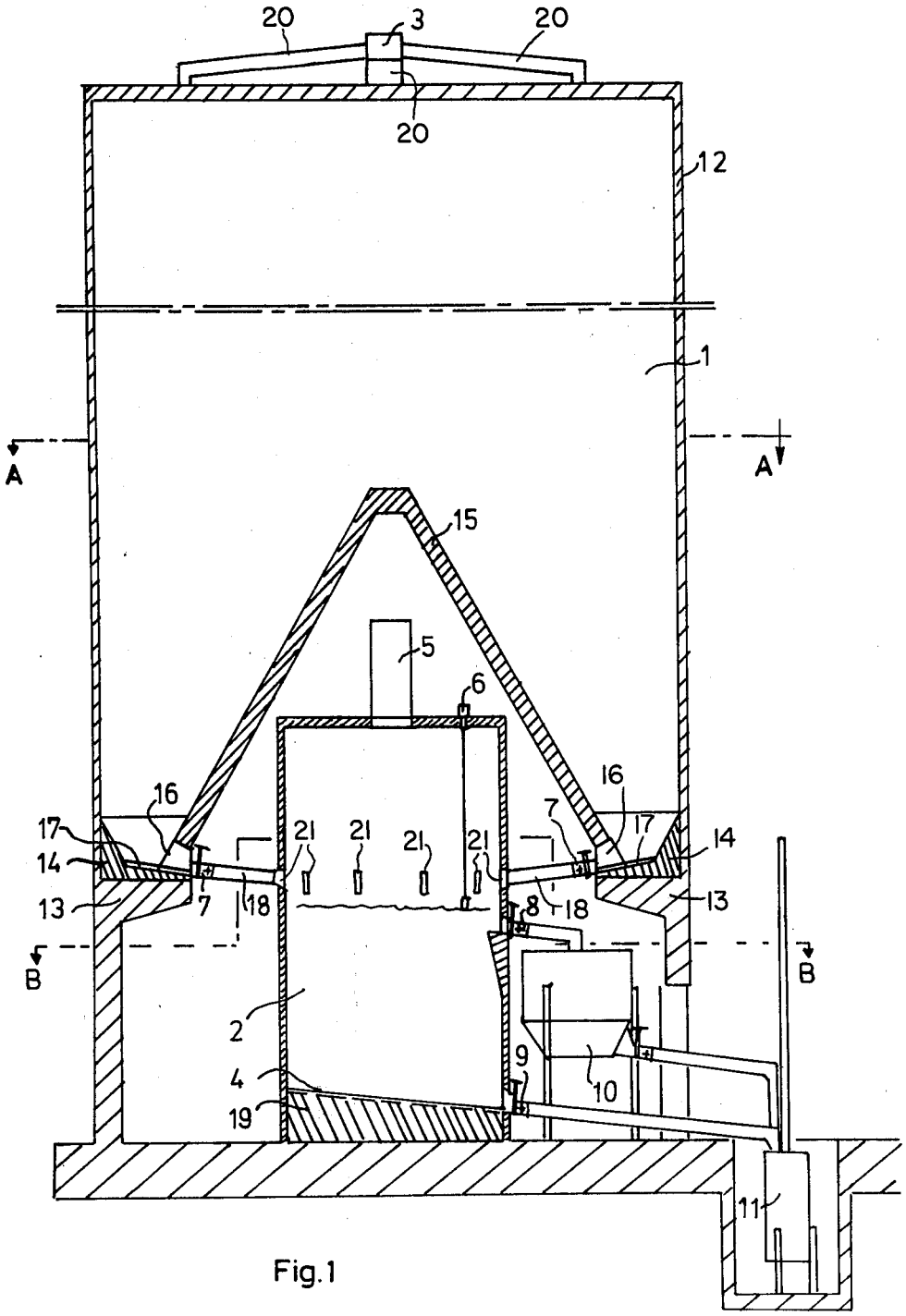
FIG. 1 shows a longitudinal cut through a silo of the invention.

FIG. 1 shows a silo of the invention which consists of a combination of a mixing silo 1 with a homogenizing silo 2. The silo 1 is supplied with material by way of a distributor "spider" 3 having trough conveyors 20. As a result of this spider-like distribution, it is possible to build up material of variable quality in layers in mixing silo 1.

The mixing silo 1 consists of a silo body 12, which has a silo bottom in the form of annular plate 13. Along the silo wall, there is a bevel 14. Above the aperture of the annular plate 13 is a conical hood 15 with several discharge apertures 16 distributed evenly on the periphery. The annular surface remaining between the bevelled wall 14 and the conical hood 15 is equipped with a loosening-up arrangement or aerating apparatus 17 at each discharge aperture 16. The discharge from the mixing silo 1 into homogenizing silo 2 is accomplished via flow control gates or "dosing and locking organs" 7. By the deliberate triggering of these discharge elements, the material supplied by the mixing silo 1 is homogenized, albeit imperfectly, by "cones" of layered material funneling downward to discharge apertures 16. The material then flows down conveying troughs 18 through inlet apertures 21 into homogenizing silo 2.

Every emptying section of the mixing silo 1 can be triggered in succession, or else according to a predetermined sequence, in such a way that the material in the mixing silo 1 will remain approximately level during the emptying process. By deliberate triggering of the aeration apparatuses 17 and of the dosing and locking organs 7, an annular formation of cones of the layersof material stored in the mixing silo 1 is ensured, one dosing and locking organ 7 after the other being triggered in succession. A rotary compressor (not shown in FIG. 1) produces the required loosening air for the aeration appartuses 17 corresponding to each dosing and locking organ 7. It will be apparent that two dosing and locking organs 7 may also be opened simultaneously, so that the overall emptying performance of mixing silo 1 may be distributed variably (e.g. 60% to 40%).

The material stored in the mixing silo 1 and homogenized in consequence of the formation of cones is discharged into homogenizing silo 2 in discrete, relatively small quantities as the discharge elements are triggered. The homogenizing silo 2 is a conventional homogenizing silo, the bottom of which is studded very closely with several aeration elements 4. In order to achieve a perfect homogenization of the material in the silo 2, it is necessary that the material level in silo 2 be kept low enough to provide an empty upper space at the ceiling of the silo 2. A large quantity of air is blown into the silo bottom 19 via the aeration elements 4 and is removed from silo 2 via the filter 5. Without this free upper space in the silo 2, a perfect homogenization of the material would not be possible. This material level is kept constant via a level recorder 6, which is coupled with the dosing and locking organs 7. Therefore, only as much material is drawn from the mixing silo 1 into the homogenizing silo 2 as is taken out via the dosing slides 8 or 9 (by-pass).

The container 10 is a weighing bin. The container 11 is a so-called air lift, a pneumatic perpendicular transporter (conveyor). The installation shown in FIG. 1 is used, for example, for the storing and homogenization of so-called "crude cement meal" (Zementrohmehl).

Figure 2:
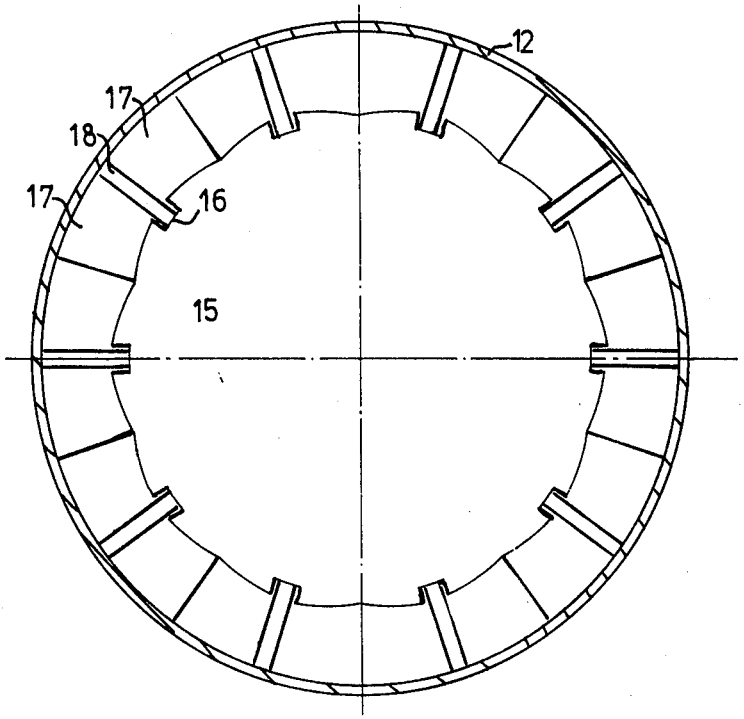
FIG. 2 shows the cross section of the silo of the invention according to FIG. 1 following the line A—A.

FIG. 2 shows a cross section of the silo as in FIG. 1 following the line A—A. The conical hood 15 in the case of this particularly preferred embodiment of the silo of the invention has ten drawing off apertures 16 into which the conveying troughs 18 empty. In the area of these conveying troughs 18 are the loosening up arrangements or aeration apparatuses 17. The reference number 12 designates the body of the silo of the mixing silo 1.

Figure 3:
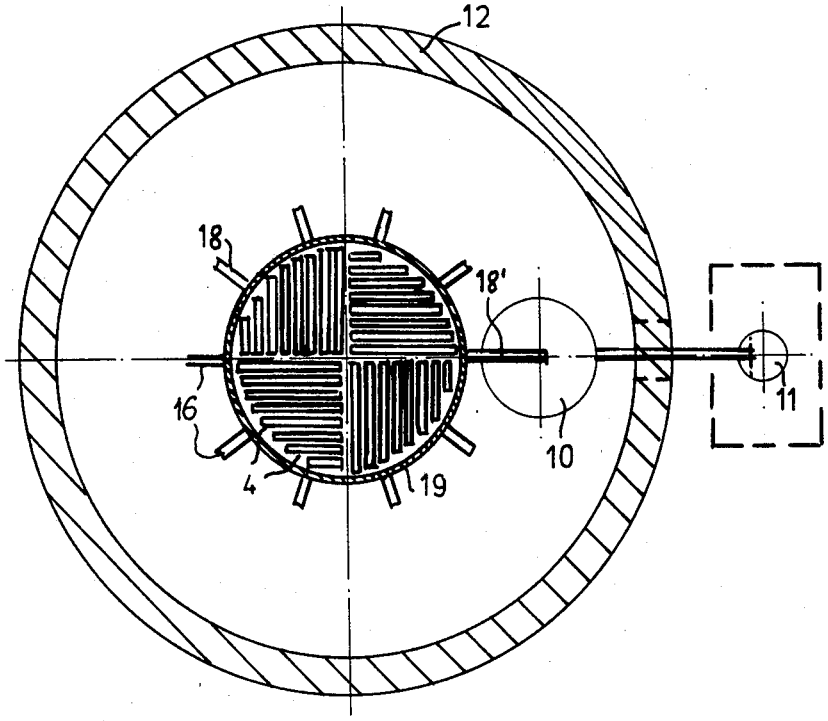
FIG. 3 shows the cross section of the silo of the invention according to FIG. 1 following the line B—B.

FIG. 3 shows a cross section through the silo according to FIG. 1 of the invention following the line B—B, whereby the silo body 12 of the mixing silo 1 encases the homogenizing silo concentrically. In FIG. 3 only the silo bottom 19 of the homogenizing silo 2 can be seen. This silo bottom 19 is studded with numerous aeration elements 4. Ten conveying troughs 18 according to FIGS. 1 and 2 lead to the homogenizing silo. One conveying trough 18' is located above the container 10. The reference number 11 designates the container 11, as shown in FIG. 1.

From the FIGS. 1 to 3 it becomes clear that the homogenizing silo 2 is located advantageously below the conical hood 15 of the mixing silo 1, whereby the upper part of the homogenizing silo 2 together with the filter 5 is located inside the conical hood 15.

The overall operation of the silo combination of the present invention can now be described. A load of material is introduced into mixing silo 1 through spider 3. As is illustrated in FIG. 1, spider 3 is provided with a system of trough conveyors (which resemble the legs of a spider) for distributing incoming material in a more or less uniform layer on top of material previously stored in mixing silo 1. Discharge apertures 16 and conveying troughs 18 provide a plurality of avenues for transferring stored material into homogenizing silo 2, and each of these avenues is controlled by a dosing and locking organ 7. When a particular dosing and locking organ 7 is open and a loosening blast of air is provided by the corresponding aeration apparatus 17, stored material will cascade through the corresponding discharge aperture 16 and into homogenizing silo 2. It will be apparent to those skilled in the art that layers of stored material above the open aperture 16 will sag downward as new material funnels in to replace that discharged through the aperture 16, so that a cone is formed. It will also be apparent that if the aperture 16 remained open indefinitely then material on the far side of mixing silo 1 would never enter homogenizing silo 2 and a pronounced depression would develop in the surface above the open aperture 16, leading to the possibility that a new load of incoming material might punch through and enter homogenizing silo 2 without being dispersed within mixing silo 1. By triggering dosing and locking organs 7 successively so that material enters homogenizing silo 2 from all regions of mixing silo 1, the present invention avoids these dangers while retaining the advantage of the natural mixing activities of the cones in the layered material stored in mixing silo 1. Dosing and locking organs 7 are triggered in such a manner that the top surface of the material stored in mixing silo 1 remains relatively level.

Homogenizing silo 2, which is of conventional design well known to those skilled in the art, receives the imperfectly homogenized material from mixing silo 1. Air enters homogenizing silo 2 through aeration elements 4 and exists through filter 5, thoroughly mixing the stored material on its way. Level recorder 6 cuts off the flow of incoming material before the level within homogenizing silo 2 becomes too high for proper mixing. Thoroughly homogenized material can be removed from homogenizing silo 2 through dosing slide 8 via weighing bin 10, or directly through dosing slide 9.

I claim:

1. A silo for finely mixng material stored therein, comprising: mixing silo means for containing layered material; a plurality of first means for conveying material out of the mixing silo means; a plurality of second means, each of the second means corresponding to one of said first means and comprising a bulk material valve positioned along said corresponding first means to selectively open and close said corresponding first means and aerating means for injecting air into the mixing silo means adjacent said corresponding first means, for coarsely mixing material by intermixing layers as material is transferred out of the mixing silo means; and homogenizing silo means communicating with the first means for containing the coarsely mixed material until it is finely mixed, said homogenizing silo means having a plurality of aerating elements in the bottom thereof.

2. A silo as in claim 1, further comprising level recorder means positioned in the homogenizing silo means for limiting transfer of material from the mixing silo means.

3. A silo as in claim 2, wherein the level recorder means comprises means for controlling each of the plurality of second means.

4. A silo as in claim 1, further comprising a filter on the ceiling of the homogenizing silo means, and wherein air is blown in via the plurality of aerating elements in the bottom of the homogenizing silo means and taken out via the filter on the ceiling of the homogenizing silo means.

5. A silo as in claim 1, further comprising trough conveyor means mounted on the mixing silo means for distributing incoming material in layers within the mixing silo means.

6. A silo as in claim 2, further comprising a filter on the ceiling of the homogenizing silo means, and wherein air is blown in via the plurality of aerating elements in the bottom of the homogenizing silo means and taken out via the filter on the ceiling of the homogenizing silo means.

7. A silo as in claim 3, further comprising a filter on the ceiling of the homogenizing silo means, and wherein air is blown in via the plurality of aerating elements in the bottom of the homogenizing silo means and taken out via the filter on the ceiling of the homogenizing silo means.

8. A silo as in claim 2, further comprising trough conveyor means mounted on the mixing silo means for distributing incoming material in layers within the mixing silo means.

9. A silo as in claim 3, further comprising trough conveyor means mounted on the mixing silo means for distributing incoming material in layers within the mixing silo means.

10. A silo as in claim 4, further comprising trough conveyor means mounted on the mixing silo means for distributing incoming material in layers within the mixing silo means.

11. A silo as in claim 6, further comprising trough conveyor means mounted on the mixing silo means for distributing incoming material in layers within the mixing silo means.

12. A silo as in claim 7, further comprising trough conveyor means mounted on the mixing silo means for distributing incoming material in layers within the mixing silo means.

13. A combination silo for finely mixing material stored therein, comprising:

mixing silo means for containing layered material, said mixing silo means having a hood mounted in the base thereof, said hood having a plurality of discharge apertures positioned about its periphery;

homogenizing silo means positioned beneath said hood for containing imperfectly mixed material until it is finely mixed, said homogenizing silo means having at least one inlet aperture therein positioned above the floor of said homogenizing silo means;

a plurality of conveying troughs connecting each of said discharge apertures with said at least one inlet aperture; and means for introducing material into said homogenizing silo means through different ones of said plurality of discharge apertures in sequence, said means comprising a bulk material valve positioned to selectively open and close each conveying trough and a corresponding aerating element positioned in said mixing silo means.

14. The silo of claim 13, wherein said homogenizing silo means has a plurality of inlet apertures positioned above the floor of said homogenizing silo means, each of said plurality of inlet apertures corresponding to one of said discharge apertures, and each of said plurality of discharge apertures with its corresponding inlet aperture, the conveying troughs connecting the discharge apertures and inlet apertures being radially disposed about the homogenizing silo means.

15. The silo of claim 14, wherein said hood is conical, and further comprising a filter mounted on top of said homogenizing silo means beneath the apex of said conical hood.

16. The silo of claim 15, wherein said means for introducing material into said homogenizing silo means additionally comprises means for keeping the upper surface of material stored in said mixing silo means substantially level.

17. The silo of claim 16, further comprising trough conveyor means mounted on the mixing silo means for distributing incoming material in layers within said mixing also means.

* * * * *